US009662559B2

(12) United States Patent
Strand

(10) Patent No.: US 9,662,559 B2
(45) Date of Patent: May 30, 2017

(54) GOLF SWING TRAINING DEVICE

(75) Inventor: Allan M. Strand, Laguna, CA (US)

(73) Assignees: Everett Strand, Laguna Nigel, CA (US); Christine Miller, Laguna Nigel, CA (US)

( * ) Notice: Subject to any disclaimer, the term of this patent is extended or adjusted under 35 U.S.C. 154(b) by 353 days.

(21) Appl. No.: 13/572,399

(22) Filed: Aug. 10, 2012

(65) Prior Publication Data

US 2013/0040749 A1 Feb. 14, 2013

Related U.S. Application Data

(60) Provisional application No. 61/575,000, filed on Aug. 12, 2011.

(51) Int. Cl.
*A63B 69/36* (2006.01)
*A63B 69/00* (2006.01)

(52) U.S. Cl.
CPC ..... *A63B 69/3608* (2013.01); *A63B 69/0059* (2013.01); *A63B 69/0057* (2013.01); *A63B 2225/09* (2013.01)

(58) Field of Classification Search
CPC ..... A63B 69/00; A63B 69/36
USPC ..... 473/205, 207, 208, 212, 215, 226, 227, 473/251, 252, 258, 457, 458
See application file for complete search history.

(56) References Cited

U.S. PATENT DOCUMENTS

| | | | | |
|---|---|---|---|---|
| 1,699,219 | A * | 1/1929 | Bemish | A63B 69/0059 473/212 |
| 3,339,926 | A * | 9/1967 | Coupar | A63B 69/0059 473/214 |
| 5,096,199 | A | 3/1992 | Wyatt, Jr. et al. | |
| 5,149,099 | A | 9/1992 | Radakovich | |
| 5,203,567 | A | 4/1993 | Erlinger et al. | |
| 5,248,146 | A | 9/1993 | Viets et al. | |
| 5,447,312 | A | 9/1995 | Nixon et al. | |
| 5,529,306 | A * | 6/1996 | Staats | A63B 69/0059 473/208 |
| 5,564,989 | A | 10/1996 | Larsen | |
| 5,711,716 | A * | 1/1998 | O'Brien | A63B 69/0059 473/201 |
| 5,890,968 | A | 4/1999 | Mingo | |
| 5,902,189 | A | 5/1999 | Schultz | |

(Continued)

OTHER PUBLICATIONS

"Swing Jacket Teaches the Perfect Golf Swing." http://www.swingjacket.com/swingjacket.html (accessed on Aug. 10, 2012).

(Continued)

*Primary Examiner* — Aarti B Berdichevsky
*Assistant Examiner* — Christopher Glenn
(74) *Attorney, Agent, or Firm* — San Diego IP Law Group LLP; Trevor Coddington, Esq.

(57) ABSTRACT

An apparatus and method is described for providing training and visual feedback of a preferred swing. The apparatus includes arm bands that are secured to the arms of a user and an alignment member that is attached to the arm bands. In use, the ends of the alignment member are visible to the user throughout an entire swing of a sport equipment without requiring head movement of the user. By observing the position of the ends of the alignment member relative to the body of the user, the user or trainer is able to determine whether a preferred swing is being executed by the user.

16 Claims, 4 Drawing Sheets

(56) References Cited

U.S. PATENT DOCUMENTS

| | | | | |
|---|---|---|---|---|
| 6,471,598 | B2 | 10/2002 | Takase | |
| 7,033,282 | B1 | 4/2006 | Flood | |
| 7,727,082 | B2 | 6/2010 | Larsen | |
| 7,758,442 | B2 | 7/2010 | Lloyd | |
| 7,896,756 | B2 | 3/2011 | Choi | |
| 7,914,388 | B2 | 3/2011 | Cox | |
| 8,177,655 | B2 | 5/2012 | Hanley | |
| 2003/0109320 | A1* | 6/2003 | Perry | A63B 69/3608 473/215 |
| 2004/0058757 | A1* | 3/2004 | Gray | A63B 21/0004 473/458 |
| 2006/0154738 | A1 | 7/2006 | Larsen | |
| 2008/0026863 | A1 | 1/2008 | Eck | |
| 2011/0183784 | A1* | 7/2011 | Celone | A63B 21/0088 473/422 |

OTHER PUBLICATIONS

"Golf Instruction: Training Aids: Swing Trainer: Figure 8 Strap". http://www.practicerange.com/Golf-Training-Aids/Figure-8-Strap.aspx (accessed on Aug. 10, 2012).

"Swing Stick—Izzo Golf". http://www.izzo.com/products/swing-stick (accessed on Aug. 10, 2012).

* cited by examiner

GOLF SWING TRAINING DEVICE

CROSS-REFERENCE TO RELATED APPLICATIONS

This application claims the filing benefit and priority of U.S. Provisional Application Ser. No. 61/575,000 filed Aug. 12, 2011, the contents which are incorporated herein by reference in its entirety.

FEDERAL SPONSORSHIP

Not Applicable

JOINT RESEARCH AGREEMENT

Not Applicable

TECHNICAL HELD

This invention pertains generally to athletic equipment, and more particularly, to athletic equipment used in training an athlete the physical mechanics of a preferred swing of a particular sport's equipment. Although the sport equipment is described herein in the context of golf equipment the inventor contemplates that invention may be utilized in other sports requiring the swing of that sport's equipment.

BACKGROUND

Generally, golf enthusiasts, both amateur and professional, seek to hit the ball farther to improve their golf game and lower their golf game score. Golf teachers and TV analysts are continually giving their opinions on how to hit the ball farther by performing a proper golf swing and how to properly execute a preferred golf swing. However, even "the experts" cannot agree on a simple method and explanation for correctly swinging the golf club.

Over the years, to achieve greater distance and accuracy, the golf swing has changed from one that relies more on the swinging of the arms and hands around the body, to one that relies more on the rotation of the body to leverage and accelerate the arms and hands.

In the past, a golfer would typically rely more on the hands and arms swinging around the body. This was true primarily because the golf shafts used in drivers and irons were typically more flexible than they are today and if the golfer swung too fast, the shaft would lag behind in the downswing and stay fully flexed at impact; the shaft did not unflex at the right time to add power and distance to the golf shot. This condition reduced power and caused errant shots. Those familiar with swinging a golf club may appreciate that when relying on the hands and arms swinging around the body, timing of the contact with the ball is critical. Hence, successful golfers playing flexible shafts have previously been referred to as "swingers."

As construction of golf shafts improved and became lighter and stiffer, the user was able to swing the golf club quicker without experiencing the undesirable club lag. The improved shafts would unflex quicker at the right time and golfers began achieving greater distance and accuracy. With a reduced effect of timing, stiffer shafts allow the golfer to incorporate more body rotation to increase the speed the arms and hands swing the club head. As equipment improved and swing speeds increased, golfers utilizing a greater swing speed became known as "hitters."

Those familiar with golf may recognize Ben Hogan as a professional golfer who achieved many successes as a golfer. Some even refer to him as the father of the modern golf swing and arguably the originator of the modern power golf swing. His swing was not only very powerful but accurate; it has often been said that you could not hide a flagstick from Hogan. Significantly, Hogan was only 5 feet 8 inches in height and weighed just over 140 pounds. Sports announcers have analyzed and continue to analyze his swing and often reference his swing because of the many favorable aspects of his swing including a powerful, accurate, efficient and effortless swing. Hogan's swing may also be characterized as one that uses the body to effectively achieve a greater swing speed of the golf dub.

The United States Golf Association and Royal and Ancient Golf Club, the sport of golf's governing bodies, attempt to strictly limit the effect improvements in golf equipment has on generating greater distance when striking a golf ball. Yet, golfers continue to search for advancements in equipment and other methods to hit the ball farther. With improved technique and body control a golfer may see improvements in the distance a ball is hit without any changes to the equipment used. Hence, understanding how to use the body to swing the golf club faster to thereby generating more club head speed and accuracy provides an advantage to the golfer.

SUMMARY

Embodiments according to aspects of the invention include an apparatus and method having a visual indicator that is entirely visible throughout the golf swing. The invention enables a golfer to establish or immediately identify and correct a proper swing plane and relationship between the body rotating with the hands and arms swinging around the body in order to increase body speed, club head speed, distance and accuracy. The golf swing trainer of the present invention both connects the golfer's arms and unifies the golfer's arms, hands and club in relation to the turning of the body to facilitate proper timing in the golf swing. The golf swing training device according to aspects of the invention is further adjustable to fit every golfer's swing and body size and fits comfortably while providing a simple system to put on and take off.

Also described herein is a golf training device that includes arm bands suitable for securing to arms of a user, and an alignment member coupled to the arm bands, with ends of the alignment member extending beyond the arm bands. Further described is a golf swing training device that includes first and second arm bands suitable for securing to arms of a user, an alignment member coupled to the arm bands with corresponding coupling brackets, and bushings in the coupling brackets that either reduce sliding of the alignment member through the bushing or facilitate sliding of the alignment member through the bushing.

Still further described is a golf swing training device that includes arm bands suitable for securing to arms of a user, a resilient member interconnecting the arm bands in a spaced but opposing relation, and an alignment member coupled to the first and second arm bands approximately transverse to a longitudinal axis of each of the arm bands.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
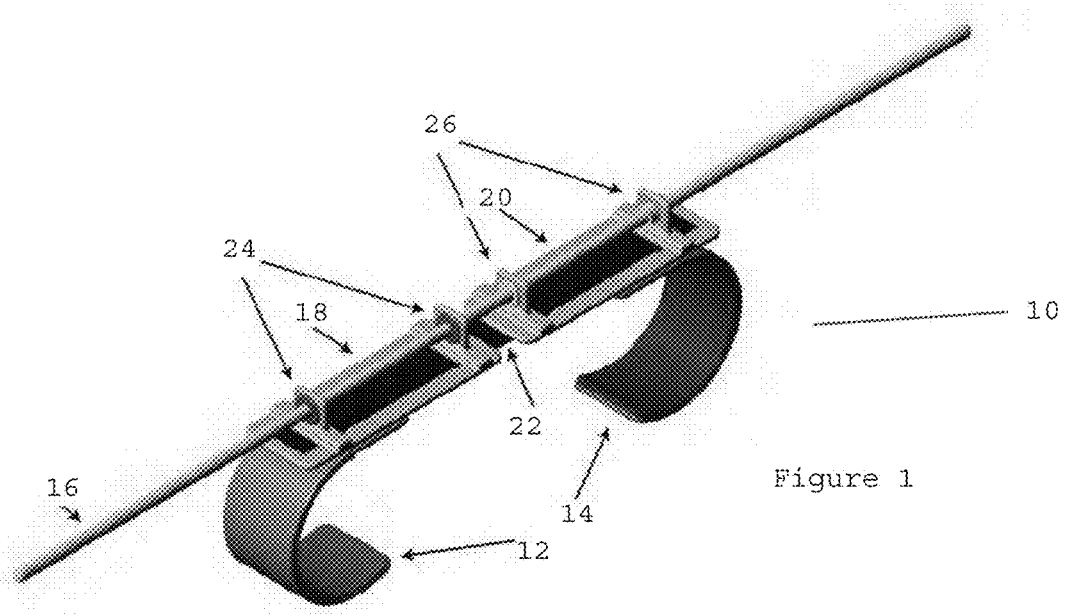
FIG. 1 is a perspective view of a golf swing training device in accordance with an embodiment of the invention.
Figure 2:
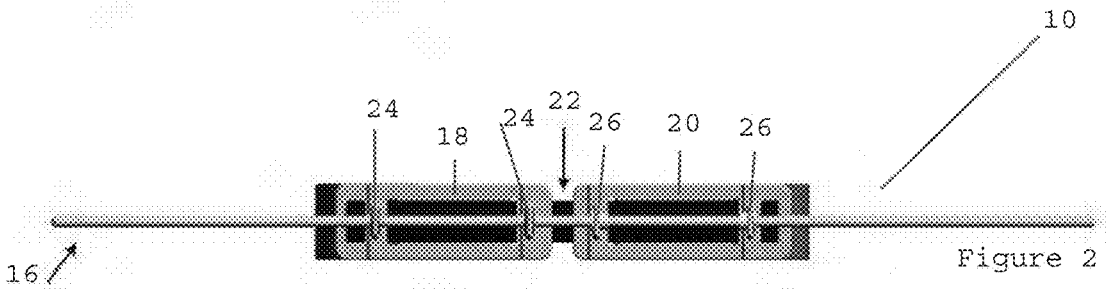
FIG. 2 is a top plan view of the golf swing training device of the type shown in FIG. 1.
Figure 3:
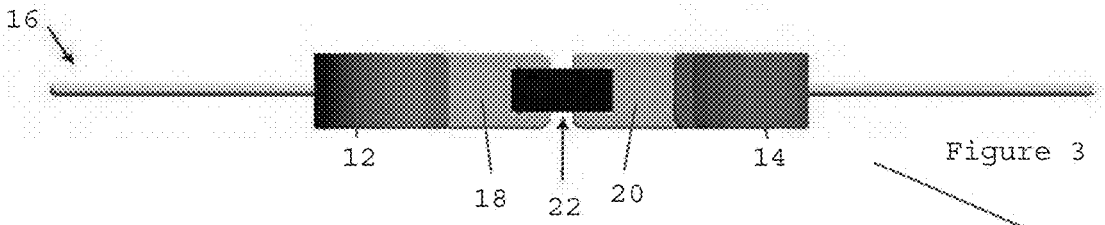
FIG. 3 is a bottom plan view of the golf swing training device of the type shown in FIG. 1.
Figure 4:
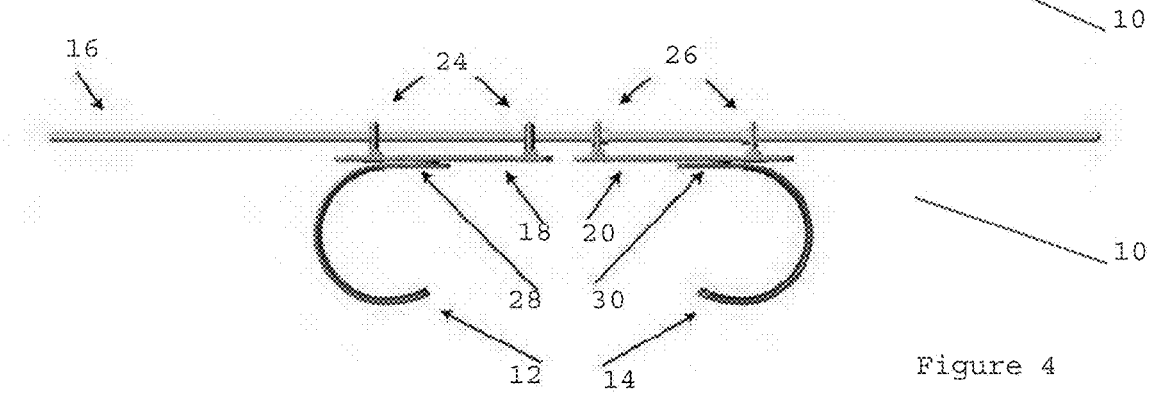
FIG. 4 is a side elevational view of the golf swing training device of the type shown in FIG. 1.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

The training apparatus 10 includes an alignment member or indicator rod 16 that provides instant, visual feedback to the user regarding the arm position relative to the body. Many sports utilize a rotational movement of the body to apply an approximately linear force to an object. For example, a discus or ball is preferably thrown in a generally straight line by first rotating the arms about the body to deliver a linear force to the ball or discuss. Likewise, a golfer rotates the arms and golf club about the body to deliver an approximately linear force to a ball when the golf club head strikes the ball.

Generally, the faster the golfer swings the golf club, the greater the force that is translated to the golf ball. Synchronization of the rotation of the arms hands and body increases the speed of the golf club head. With regard to a golfer's spine angle, the more horizontally the upper body rotates, the easier it is for the rotation of the body to stay synchronized with the rotation of the arms and hands, thus, generating more speed and power. Conversely, if the upper body is unsynchronized relative to the spine, for example, shoulders tipping up and down while the hips and spine attempt to rotate, the more separated the body becomes with the rotation of the arms and hands, resulting in less speed and power that the body can generate. An increase in the rotation of the hands and arms alone cannot make up for the speed loss caused by not using the body properly. Instead, distance is lost and accuracy is sacrificed.

The golf swing training device 10 is designed to properly communicate to the golfer the most efficient and effortless way to make a consistent, powerful, accurate golf swing using proper rotation of the body, hands and arms. The various positions of the indicator rod 16 throughout the swing enables a golfer, while swinging, to determine whether the arms hands and body are rotating correctly and enables immediate adjustment to produce either more power, accuracy or both.

For example, when executing a full golf swing (for right-handed golfers), when the user positions the golf club head adjacent the golf ball, it is desirable for a left end of the indicator rod 16 to point up but parallel to the target line. As the golfer rotates the golf club up and away from the golf ball, the left side of the indicator rod 16 preferably rotates to the right, horizontally, and arrives at a position at the top or completion of the backswing that is at least 90-degrees from the target line (the preferred line or path of ball travel) while the longitudinal axis of the indicator rod 16 is preferable parallel to the ground.

As the user begins a downswing of the golf club, the left end of the indicator rod 16 preferably begins to point slightly up as the right end of the indicator rods drops down. As the user continues the downswing, as the golf club head impacts the golf ball, the alignment member 16 should be in a position nearly identical to the position when the user positions the golf club head adjacent to the golf ball. As the user continues to rotate the club after impact, for example follow-through, the left end of the indicator rod 16 should rotate left horizontally as it moves up before inverting or exchanging relative positions with the right end of the indicator rod with the completion of the golf swing. Stated otherwise, the desired ending position of the alignment member 16, rotates the end of the alignment member 16 approximately 180 degrees from the position at full backswing, while the rod 16 is aligned in a plane relative to the ground similar to a plane relative to the ground at full backswing. Also, at the ending position of follow through, the right end of the indicator rod 16 should point slightly up and rotated at least 45 or more degrees toward the target from its starting position.

The position of the ends of the indicator rod 16 may also be utilized by the golfer to identify undesirable body or arm positions throughout a golf swing. For example: early in the backswing, if the left end of the indicator rod dips down or lowers below horizontal, the position of the rod indicates that the golfer is taking the club back closed or shut, which means the club face is not opening properly and the golfer should make significant compensations in the last part of his backswing in order to be positioned at the top of the backswing properly on-plane. Also, if a golfer's body rotates less than or more than 90-degrees in the backswing, the undesired position of the indicator rod should be readily visible to the golfer. Further, in the downswing, if the right end of the indicator rod does not rotate past impact, the golfer may surmise that the golfer has cast the club with the arms early. It has been observed that the early casting of the club actually hinders the rotation of the body and reduces power or accuracy.

Figure 8:
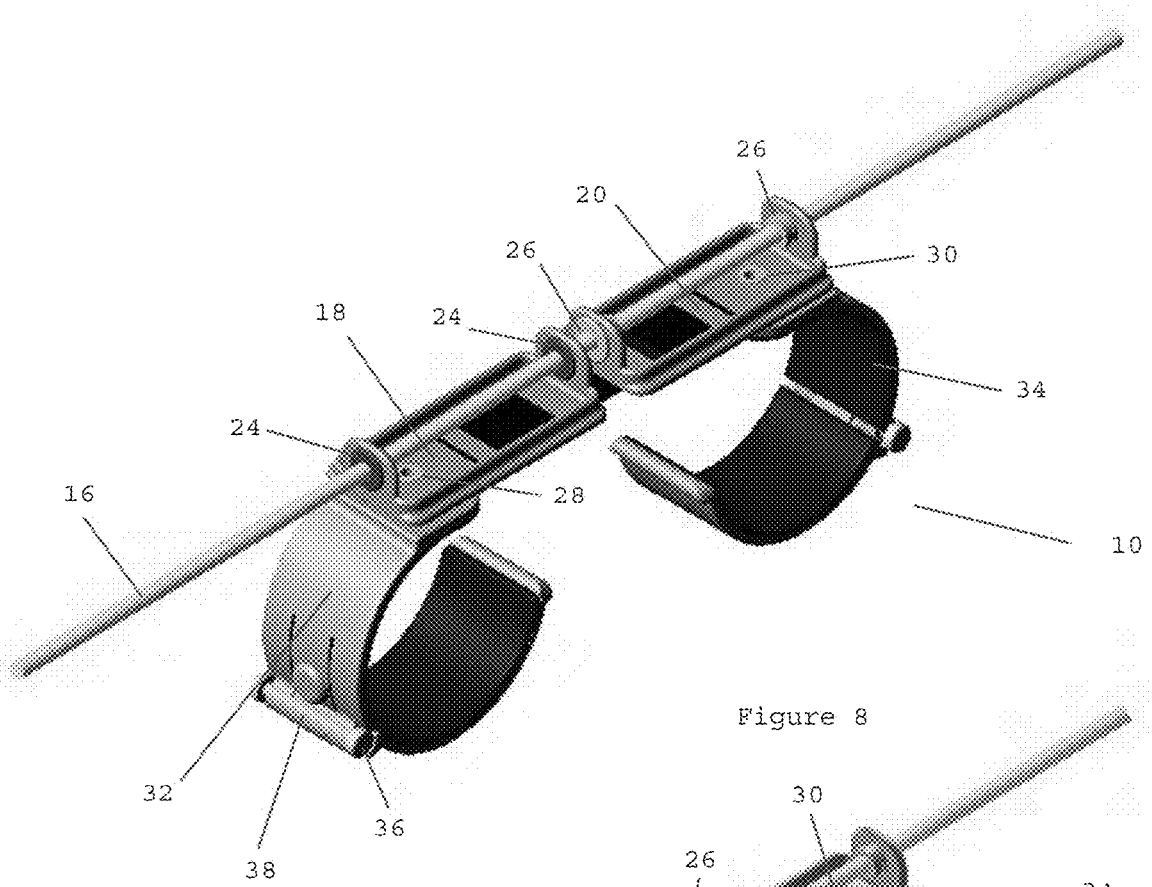
FIG. 8 is a perspective view of a golf swing training device in accordance with an embodiment of the invention.
Figure 9:
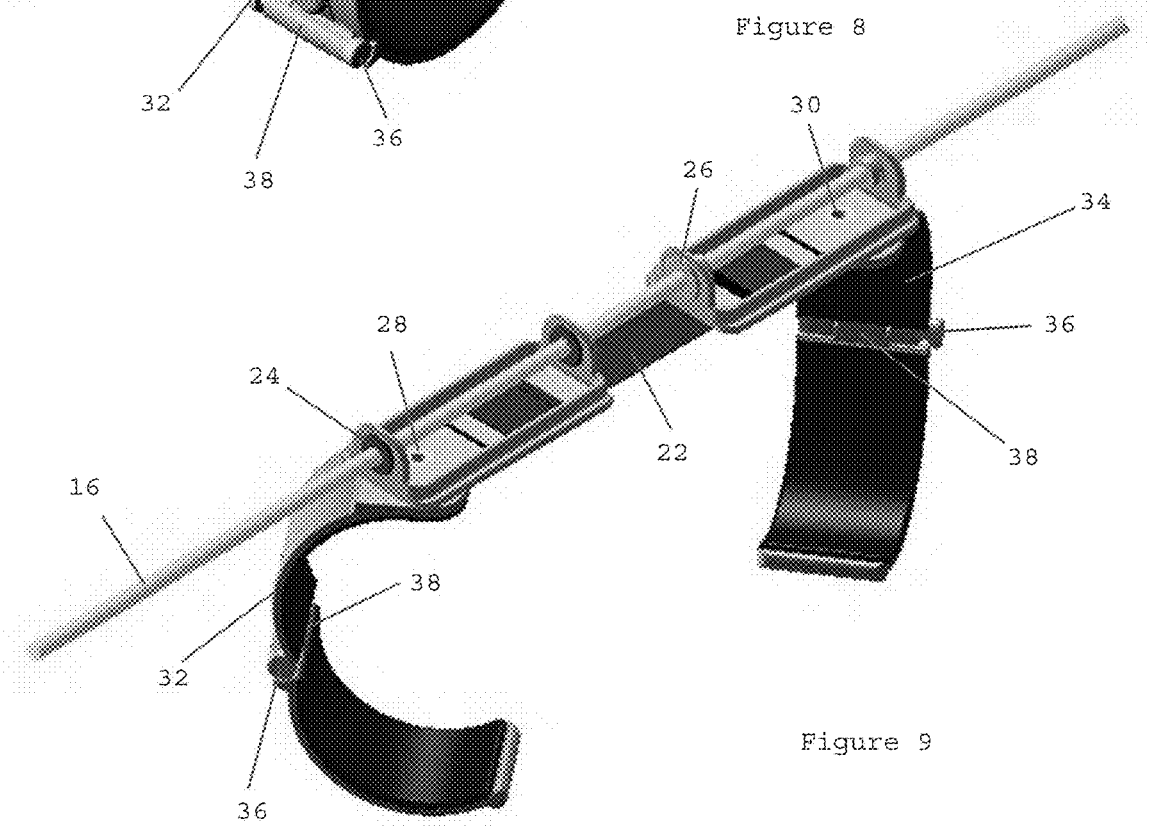
FIG. 9 is a perspective view of the golf swing training device of the type shown in FIG. 8 having the arm bands swiveled and expanded.

Turning attention now to the Figures, embodiments of the golf swing training device 10 of the present invention will now be described in more detail and are generally shown in FIGS. 1-4. The training apparatus 10 of the present invention generally includes arm bands 12 and 14 that fit at least partially around the outside portion of a user's upper arms, for example. The arm bands are preferably flexible and are constructed to bend or expand to different sized arms. FIGS. 8 and 9 illustrate an example of hinged expandable arm bands 32 and 34. The arm bands 32 and 34 are partitioned and held together with a hinge 38 that allows a free end of the arm band to rotate about a pin 36 of the hinge 38. A portion of the pin 36 includes teeth that restricts the hinge from rotating. The two-piece arm bands and pins allow the arm bands to both ratchet and lock for custom sizing. The lock mechanism or pin 36 is actuated from a first locking position (see FIG. 8) to a second rotating position (see FIG. 9) to allow the user to adjust the relative size of the arm band. When the lock mechanism is locked, a portion of the teeth of the pin holds the arm band in a position having the adjusted relative size of the arm band. Those skilled in the art will appreciate that other adjustments, clasps, and hinges, for example, may be incorporated into the arm bands to provide an adjustable and expandable arm band. Without limitation intended, for example, the expandable arm bands may be divided but held together with a lock mechanism so that a tab portion of one section of the arm band slides in a slot of the other section. The two-piece arm bands with lock mechanism, with tabs and slots, would allow the arm bands to both increase or decrease a relative diameter of the arm band, thereby allowing for custom sizing of the arm band. Further, the inside of the arm bands 12 and 14 may be lined with felt or other padding to further provide a comfortable fit against the user's arm.

The alignment member 16 may be of known suitable construction, including, for example, a long, small-diameter, light-weight rod. The alignment member 16 is engaged with the arm bands through coupling brackets 18 and 20. Each bracket is preferably provided with at least two bushings that are adapted for receiving the alignment rod, wherein the plurality of bushings provides stability to the rod 16 as it slides through the bushings. First coupling bracket 18 includes bushings 24 having apertures sized to allow the alignment member to slide through the aperture. In the preferred embodiment, the bushings 24 are constructed of a compressible rubber and the aperture has an inner diameter that is slightly less than the outer diameter of the alignment member 16. In this manner, when the rod 16 is slid into bushing 24 the rubber compresses but provides a frictional resistance to the sliding of the rod 16 within the bushing 24. It may be said that the bushing 24 has a high coefficient of friction because the rod 16 meets resistance when sliding in the bushing 24. The second coupling bracket 20 includes bushings 26 having an aperture that is sized to allow the alignment member to slide through the aperture. In the preferred embodiment, the bushings 26 are constructed of a plastic nylon, polypropylene, polytetrafluroethylene (PTFE) or other suitable plastic of desirable, known construction having a low coefficient of friction. The bushings 26 have an inner diameter that is slightly larger than the outer diameter of the alignment member 16. In this manner, when the rod 16 is slid into bushing 26 the rod 16 is met with little resistance.

A resilient member or band 22 interconnects the arm bands 12 and 14 in spaced relation. The band 22 may be constructed of elastic or other suitable resilient material and the length may be adjusted depending on the desired separation distance between the arm bands. As the distance between the arm bands increases and decreases the alignment member 16 slides in the bushings 26 of the coupling bracket 20. Swivel mechanisms 28 and 30 of known suitable construction are used to couple the arm bands 12 and 14 to the coupling brackets 18 and 20. When the golfer swings the golf club from the backswing through the follow through, the swivels 28 and 30 allow the arm bands to pivot slightly, providing additional comfort for the user.

Figure 5:
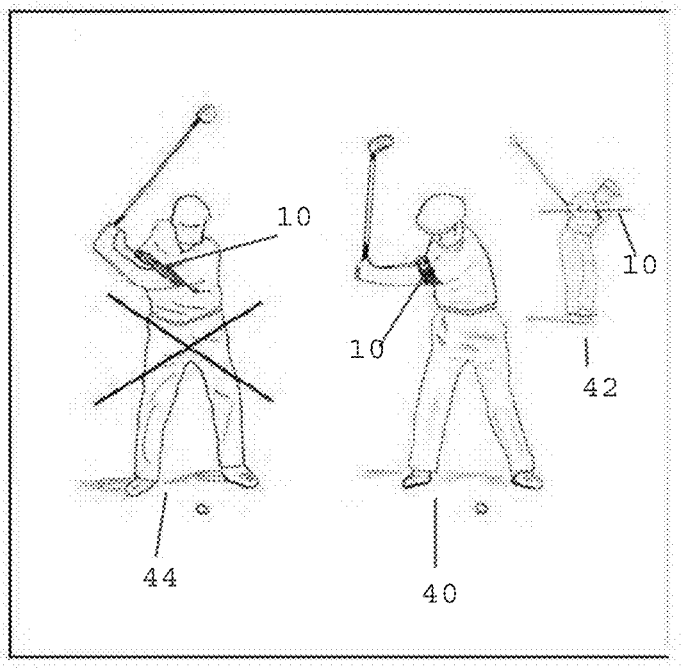
FIG. 5 depicts three human forms swinging a golf club utilizing the golf swing training device of the type shown in FIG. 1.

Referring now to FIG. 5 a golfer is shown holding a golf club in a backswing position 40 and 42. The alignment member is shown with the ends of the alignment member in a preferred orientation relative to the ground and golf ball. With reference to the golfer identified as 44, the position of the golfer's hips and shoulders are not preferred and the ends of the alignment member 16 are consequently in an undesired orientation relative to the ground and golf ball.

Figure 6:
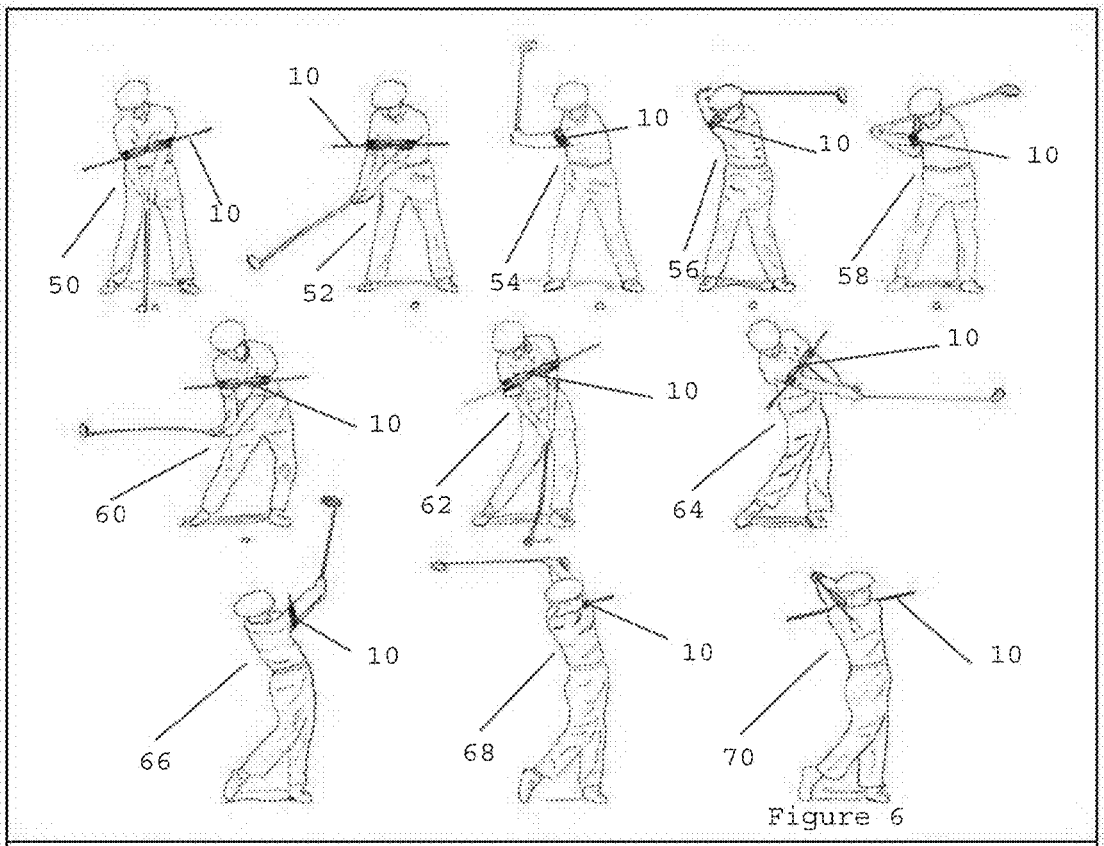
FIG. 6 depicts a front view of a series of human forms at various stages of swinging a golf dub utilizing the golf swing training device of the type shown in FIG. 1.

FIG. 6 depicts a front view of a sequence of preferred orientations 50-70 of a golfer and the corresponding position of the alignment member 16. As the golfer first addresses the ball 50 the longitudinal axes of alignment member 16 aligns with the approximate preferred trajectory of the ball and the end of the alignment member near the ball is slightly higher than the end further away from the ball. As the golfer rotates the arms and body to move the golf club backward 52-56, and as the golfer begins to swing the dub forward 58-60, the longitudinal axis of the alignment member 16 should remain relatively parallel with the ground. As the golfer 62 swings the golf dub near the golf ball 62, the position of the alignment member should return to a position similar to the position when the ball is addressed (50). As the golfer continues to swing the dub to follow through 64-70 the end of the alignment member, that was initially furthest from the ball, should rotate past the initial position and its finish position should point towards the approximate desired trajectory of the ball.

Figure 7:
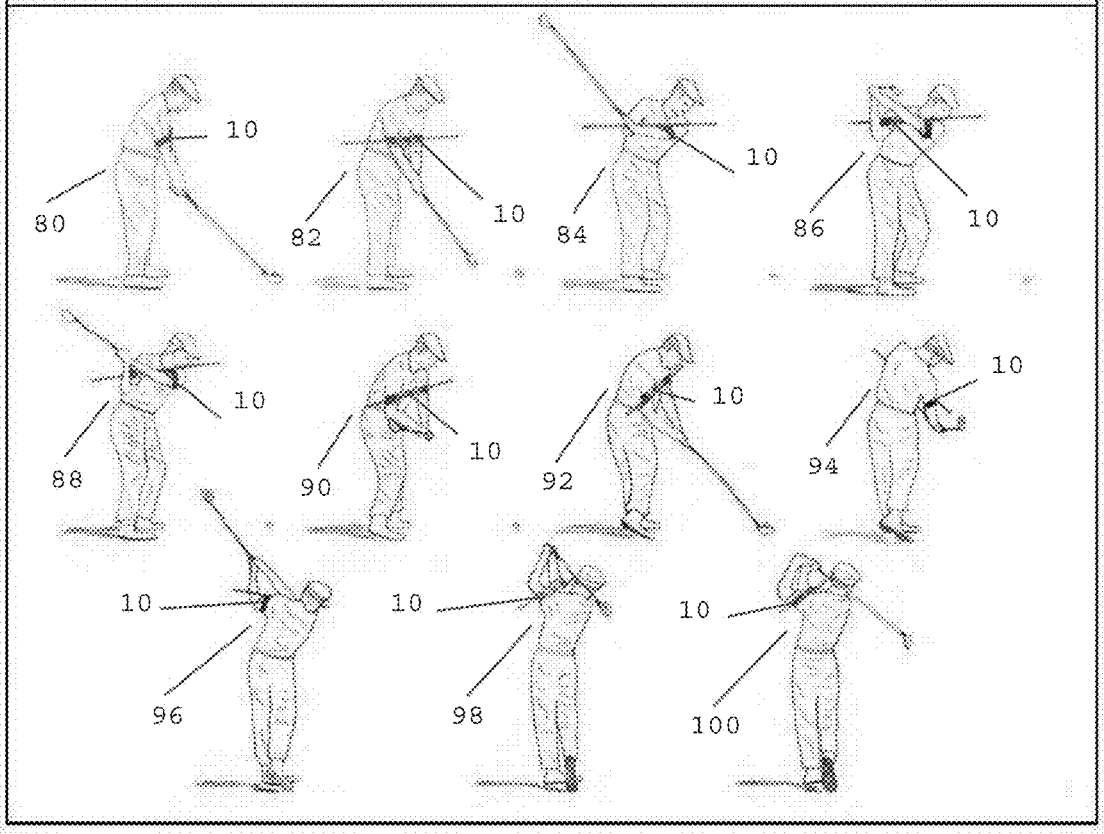
FIG. 7 depicts a front view of a series of human forms at various stages of swinging a golf dub utilizing the golf swing training device of the type shown in FIG. 1.

FIG. 7 depicts a side view of a sequence of preferred orientations 80-100 of a golfer and the corresponding position of the alignment member 16. As the golfer first addresses the ball 80 the longitudinal axes of alignment member 16 aligns with the approximate preferred trajectory of the ball and the end of the alignment member near the ball is slightly higher than the end further away from the ball. As the golfer rotates the arms and body to move the golf dub backward 82-86, and as the golfer begins to swing the club forward 88-90, the longitudinal axis of the alignment member 16 should remain relatively parallel with the ground. As the golfer 92 swings the golf club near the golf ball the position of the alignment member should return to a position similar to the position when the ball is addressed (80). As the golfer continues to swing the club to follow through 94-100 the end of the alignment member, that was initially furthest from the ball, should rotate past the initial position of the ball and its finish position should point towards the approximate desired trajectory of the ball. As depicted in the sequence of golfing positions, the golf swing training apparatus 10 provides a visual indicator of the position of the golfer's arms and body that is visible without requiring a turn of the golfer's head.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A training device, comprising:

arm bands suitable for securing to arms of a user;

first and second u-shaped coupling brackets separate from said arm bands; each bracket defined by a base and opposing sides extending from said base, said sides having axially aligned bores extending there through and adapted to receive an alignment member extendable through the aligned bores of each said u-shaped coupling bracket;

swivels interconnecting said base of each of said brackets and a corresponding one of said arms bands;

a resilient member having a first end portion connected to said first bracket and a second end portion coupled to said second bracket, said resilient member interconnecting said arm bands in an elastic spaced relation; and said alignment member coupled to said arm bands by way of said brackets and swivels, said alignment member extending through the bores of said brackets and coupled to said arm bands approximately transverse to a longitudinal axis of said arm bands, said alignment member having uncoupled proximal and distal ends of said alignment member that extend beyond outward facing sides of said arm bands.

2. The training device as recited in claim 1, wherein said resilient member expands and contracts between the arm bands.

3. The training device as recited in claim 2, wherein said swivels interconnect said brackets and said arm bands to allow rotation of said arm band.

4. The training device as recited in claim 1, wherein said alignment member comprises an indicator rod of sufficient length to indicate an orientation of arms of a user relative to an upper body of a user.

5. The training device as recited in claim 1, wherein said arm bands are further suitable for securing to an upper portion of the arms of the user.

6. The training device as recited in claim 3, wherein said brackets include bushings positioned within said bores, said bushings comprised of a material that provides frictional resistance to sliding of the alignment member through said bores.

7. The training device as recited in claim 2, wherein said brackets include bushings positioned within said bores, said bushings comprised of a material to facilitate a smooth sliding of the alignment member through said bores.

8. A swing training device, comprising:

first and second arm bands suitable for securing to arms of a user;

a resilient member interconnecting said first and second arm bands in a spaced but opposing relation, a first end portion of said resilient member coupled to a first swivel attached to said first arm band and a second end portion of said resilient member coupled to a second swivel attached to said second arm band;

an alignment member coupled to said first and second arm bands, said alignment member coupled to said arm bands approximately transverse to the longitudinal axis of each of said arm bands, said alignment member having uncoupled proximal and distal ends that extend beyond outward facing sides of said first and second arm bands;

first and second u-shaped coupling brackets that are not wing nuts, said first and second u-shaped coupling brackets having a bore extending through opposing ends of each said first and second coupling bracket, said first swivel coupled to said first coupling bracket and said first arm band, said second swivel coupled to said second coupling bracket and said second arm band; and an alignment member that extends through the bores of said first and second u-shaped coupling brackets.

9. The swing training device as recited in claim 8, wherein said first and second arm bands and alignment member are coupled with corresponding first and second coupling brackets, said first and second arm bands being coupled to said corresponding coupling brackets in a manner to allow rotation of said arm band.

10. The swing training device as recited in claim 8, wherein said alignment member couples to said first and second coupling brackets by sliding through bushings of each of said coupling brackets.

11. The swing training device as recited in claim 10, wherein at least one of said bushings is comprised of a material that provides frictional resistance to sliding of the alignment member through said at least one of said bushings.

12. The swing training device as recited in claim 10, wherein at least one of said bushings is comprised of a material to facilitate a smooth sliding of the alignment member through said at least one of said bushings.

13. The training device as recited in claim 6, wherein the material is rubber.

14. The swing training device as recited in claim 11, wherein the material is rubber.

15. The training device as recited in claim 7, wherein the material is a plastic selected from the group consisting of: nylon, polypropylene, and polytetrafluroethylene.

16. The swing training device as recited in claim 12, wherein the material is a plastic selected from the group consisting of: nylon, polypropylene, and polytetrafluroethylene.

* * * * *